United States Patent [19]

Lin

[11] Patent Number: 4,957,665

[45] Date of Patent: Sep. 18, 1990

[54] AIR COOLING DEVICE FOR ELECTRIC FAN

[75] Inventor: Run-Nin Lin, Taiwan, Taiwan

[73] Assignee: Alphacom Enterprise Co., Ltd., Taipei, Taiwan

[21] Appl. No.: 427,274

[22] Filed: Oct. 24, 1989

[51] Int. Cl.[5] ..... B01F 3/04

[52] U.S. Cl. ..... 261/95; 261/99

[58] Field of Search ..... 261/95, 99

[56] References Cited

U.S. PATENT DOCUMENTS

| | | | |
|---|---|---|---|
| 2,048,694 | 7/1936 | Harris | 261/99 |
| 2,580,013 | 12/1951 | Gazda | 261/99 |
| 2,603,468 | 7/1952 | Sutton | 261/99 |
| 2,653,017 | 9/1953 | Frost | 261/99 |
| 3,321,931 | 5/1967 | Lehmkuhl | 261/95 |

*Primary Examiner*—Tim Miles

*Attorney, Agent, or Firm*—Varndell Legal Group

[57] ABSTRACT

An air cooling device for electric fan comprises of a front cover, a back cover and a water absorbing ceramic, in which the front cover and the back cover are screwed up together with the water absorbing ceramic squeezed in therebetween to define a water receiving space for filling therein of cooling water. The cooling water is further absorbed by the water absorbing ceramic to further let the air current which is set up by an electric fan and passes therethrough be cooling down.

5 Claims, 3 Drawing Sheets

AIR COOLING DEVICE FOR ELECTRIC FAN

BACKGROUND OF THE INVENTION

Electric fan is a device comprising revolving blades used to set up a current of air for ventilating or cooling. Actually, an electric fan can only change the air from static status to dynamic status and can not change the nature of the air. Even if an electric fan is turned on to its maximum capacity, it still can not effectively help relieve summer heat.

It is therefore, the main object of the present invention to provide a device for mounting on the wire protective front cover of a regular electric fan to help cooling down the air while air current is set up by the electric fan.

Another object of the present invention is to provide such an air cooling device for electric fan which is inexpensive to manufacture.

A yet further object of the present invention is to provide such an air cooling device for electric fan which may be alternatively mounted on the air outlet of an air conditioner to reinforce the cooling effect.

According to the present invention, an air cooling device for electric fan is generally comprised of a front cover screwed up with a back cover with a water absorbing ceramic squeezed in between the inner flange of the front cover and the inner flange of the back cover, such that when water is filled into the enclosed space defined by the inner flanges of the front and back covers it will be immediately absorbed by the water absorbing ceramic and moisture will be resulting in the upper space inside the device. When air current generated by an electric fan is continuously passing through the device, the air flow will be cooling down effectively.

DETAILED DESCRIPTION OF THE PREFERRED EMBODIMENT

Figure 1:
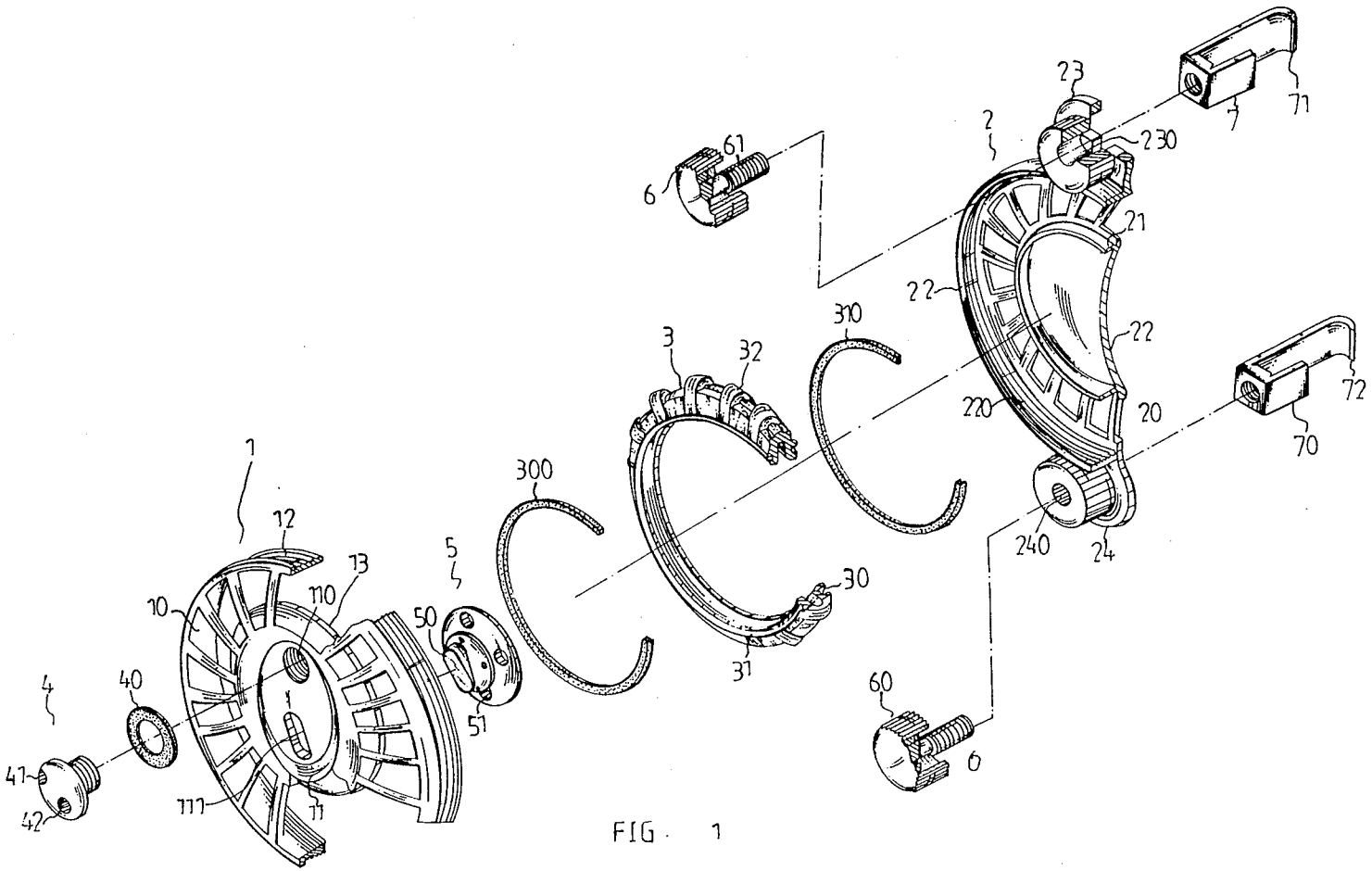
FIG. 1 is a perspective exploded view of the present invention.
Figure 2:
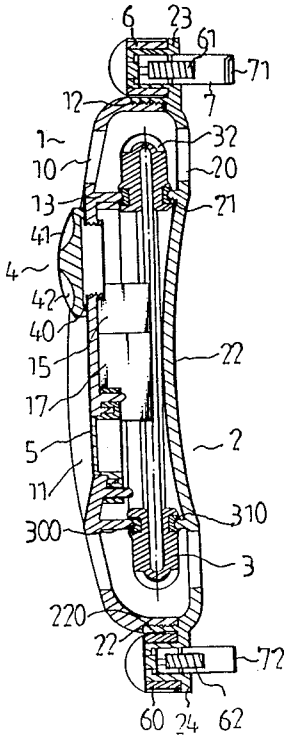
FIG. 2 is a sectional view of the present invention.

Referring to FIGS. 1 and 2, an air cooling device for electric fan according to the present invention is generally comprised of a front cover 1 and a back cover 2 respectively connected together to form a housing for setting therein a water absorbing ceramic 3, and for mounting thereon externally of a water inlet control knob 4, a water gauge 5, two fastening knobs 6 and 60, and two fastening plates 7 and 70.

Figure 3:
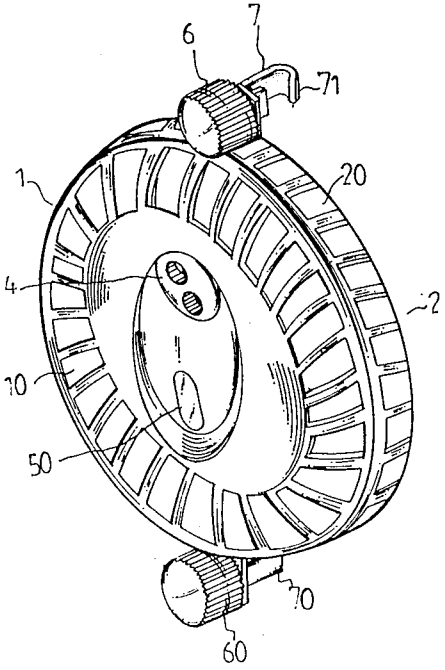
FIG. 3 is a perspective assembly view of an air cooling device for electric fan embodying the present invention.

The front cover 1 includes a plurality of rectangular openings 10 equidistantly disposed around the periphery of the front face, an oval recess 11 in the center, a bolt hole 110 made on the oval recess 11 for connection thereto of the water inlet control knob 4 with a water seal 40 tightly squeezed in therebetween, an elongated hole 111 made on the oval recess 11 below the bolt hole 110 for setting therein of the water gauge 5, and an external thread 12 on the circular side-wall. The water gauge 5 comprises a transparent unitary canopy member 50 on the top and through-holes 51 on the bottom. When the water gauge 5 is mounted on the front cover 1 from the back side, the transparent unitary canopy member 50 is seated in the elongated hole 111 for viewing water lever therethrough. The water inlet control knob 4 comprises two circular holes 41 and 42 for insertion therein of fingers to turn the water inlet control knob 4 in or out. By means of the ring-shaped water seal 40, the bolt hole 110 which concomitantly serves as a water inlet is tightly sealed against leakage of water. The front cover 1 further comprises an inner flange 13 having a key 130 made thereon internally at the top for setting in the notch 301 of the water absorbing ceramic 3 to let the water absorbing ceramic 3 be firmly retained when the front cover 1 and the back cover 2 are screwed up together. The back cover 2 includes a plurality of rectangular openings 20 equidistantly disposed around the periphery of the face region to respectively aim at the rectangular openings 10 of the front cover 1, a spherical surface portion 22 in the center to match with the center ring portion of the wire protective cover of an electric fan, an inner flange 21 in the center around the spherical surface portion 22 to support the water absorbing ceramic 3, two bolt seats 23 and 24 respectively made at the top and the bottom, and internal thread 220 made on the circular side-wall 22 for connection with the external thread 12 of the front cover 1. The two bolt seats 23 and 24 are having holes 230 and 240 respectively piercing therethrough for insertion therethrough of the screw rods 61 and 62 of the two fastening knobs 6 and 60 to secure the two fastening plates 7 and 70 to the back cover 2 respectively. The two bolt seats 23 and 24 also comprises a cross notch (not shown) at the back for seating therein of the front end of the fastening plate 7 or 70 to let the fastening plate 7 or 70 be more stably secured thereto. The two fastening plates 7 and 70 each comprises a unitary hook end 71 or 72 to hook up the wires of the front protective cover of an electric fan so as to let the present device be secured to an electric fan. The water absorbing ceramic 3 has a circular body structure comprising convex-concave outer wall surface 32, two circular grooves 30 and 31 in the front and back side for mounting thereon of the inner flanges 13 and 21 of the front cover 1 and the back cover 2 respectively. Before mounting of the inner flanges 13 and 21, two circular waterproof packings 300 and 310 are respectively set in the circular grooves 30 and 31 to protect against leakage of water when the device is in operation. As soon as all the said component parts are respectively connected together, an air cooling device of the present invention is thus formed, as illustrated in FIG. 3.

Figure 4:
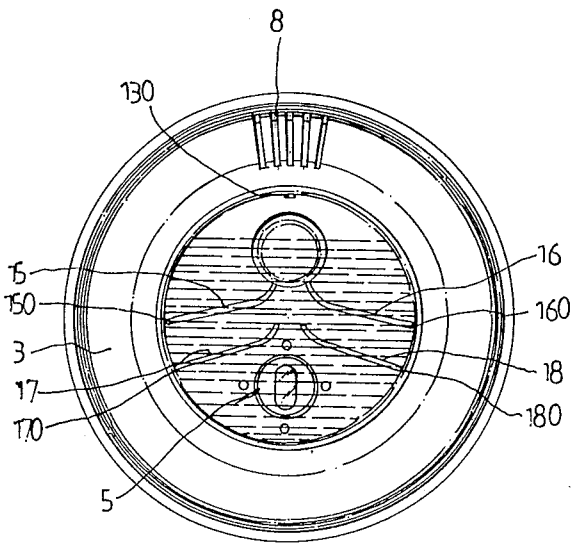
FIG. 4 is a schematic drawing illustrating the operation of the present invention.

The operation of the present invention is very simple and outlined hereinafter with reference made to the annexed drawings of FIGS. 2 and 4. The water inlet control knob 4 is removed from the bolt hole 110 for filling therethrough of water into the enclosed inner chamber defined by the two inner flanges 13 and 21 and the water absorbing ceramic 3. The water level in the enclosed inner chamber can be viewed through the transparent canopy portion 50 of the water gauge 5. After filling of water, the water inlet control knob 4 is screwed in the bolt hole 110 again to seal the water inlet. Because the lower portion of the water absorbing ceramic 3 is immersed in water, the water will be absorbed into the absorbing ceramic 3 and cool moisture will be filling the upper air circulation space 8. The device is then mounted on the wire protective cover of an electric fan with the two fastening plates 7 and 70 secured thereto. Through the adjusting of the fastening knobs 6 and 60, the connection of the two fastening plates 7 and 70 with the wires of the protective cover of an electric fan can be more tightly secured. When the associated electric fan is turned on, air flow is blowing through the rectangular holes 20 of the back cover 2, the air circulation space 8, the convex-concave outer wall surface 32 of the water absorbing ceramic 3 and the rectangular holes 10 of the front cover 1. While passing through the convex-concave outer wall surface 32 of the water absorbing ceramic 3, the air flow is cooling down. Therefore, it can efficiently help to reduce indoor ambient temperature.

Figure 5:
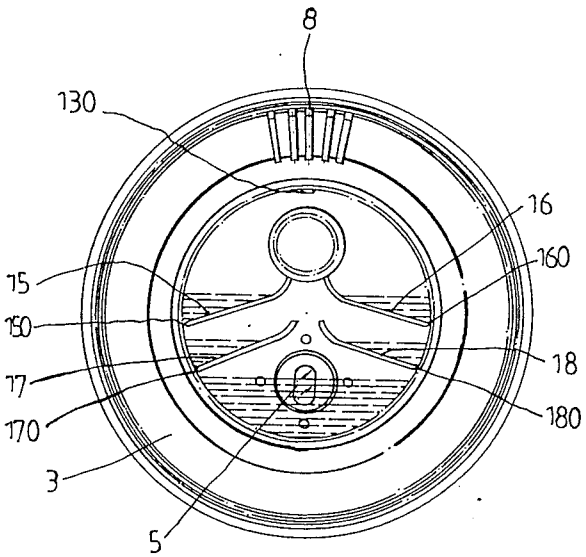
FIG. 5 is a back side sectional view of the present invention.

Referring to FIG. 5, the front cover 1 further includes four pieces of water bumpers 15, 16, 17 and 18 at the inner side and respectively disposed at an upper left, an upper right, a lower left and a lower right positions. The water bumpers 15, 16, 17 and 18 have pointed front ends 150, 160, 170 and 180 respectively stopped against the inner wall surface of the water absorbing ceramic 3. When the front cover 1 is screwing up with the back cover 2, the water bumpers 15, 16, 17 and 18 are driven to rotate simultaneously and to rub in the inner wall surface of the water absorbing ceramic 3. Thus, five water receiving spaces are defined between the four water bumpers 15, 16, 17 and 18 and the water absorbing ceramic 3 for receiving water respectively. Through this arrangement, the water filled in the device can be well maintained and effectively absorbed by the water absorbing ceramic to keep the water absorbing ceramic cool.

I claim:

1. An air cooling device for electric fan, including:

a front cover comprising a circular side wall having an external thread made thereon, a plurality of rectangular openings equidistantly disposed around the periphery of the front face, an inner flange at the inner side having a key made at the inner top, an oval recess having made thereon a bolt hole for connection thereto of a water inlet control knob and an elongated hole for setting therein of a water gauge, and four water bumpers made at the inner side below said bolt hole;

a back cover comprising a circular side wall having an internal thread made thereon for connection with the external thread of the circular side wall of said front cover, a plurality of rectangular openings properly set to aim at the rectangular openings of said front cover, two bolt seats respectively set at the top and the bottom each having a through-hole made thereon for insertion therethrough of a fastening knob to secure a fastening plate thereto, and an inner flange defining therein a spherical surface for receiving the center ring of the wire protective cover of an electric fan; and a water absorbing ceramic having a circular body structure comprising a convex-concave outer wall surface and two circular grooves respectively for setting therein of the inner flanges of said front and back covers;

wherein said front cover is screwed up with said back cover with the water absorbing ceramic received therein and tightly squeezed in between the inner flange of said front cover and the inner flange of said back cover to define therein a water receiving space for filling of water, and the two fastening plates which are connected to said two bolt seats are secured to the wire front cover of an electric fan to let air flow pass through the air cooling device.

2. The air cooling device for electric fan according to claim 1, wherein said water inlet control knob comprises a unitary screw rod having mounted thereon a water seal to firmly seal said bolt hole so as to prevent from leakage of water, and two circular holes for insertion therein of fingers to screw the screw rod in or out of said bolt hole.

3. The air cooling device for electric fan according to claim 1, wherein two circular waterproof packings are respectively set in said two circular grooves of said water absorbing ceramic before mounting of the inner flanges of said front and back covers so as to protect against leakage of water from the water receiving space defined between the inner flanges of said front and back covers and said water absorbing ceramic when the air cooling device is in operation.

4. The air cooling device for electric fan according to claim 1, wherein said two bolt seats of said back cover each comprises further a crossed notch for seating therein of a fastening plate to let the fastening plate be fixedly secured thereto by a securing knob.

5. The air cooling device for electric fan according to claim 1, wherein said water gauge comprises a transparent canopy member set in said elongated hole of said front cover permitting viewing of the level of the water contained in the device.

* * * * *